US005724837A

United States Patent [19]

Shin

[11] Patent Number: 5,724,837

[45] Date of Patent: Mar. 10, 1998

[54] CLOTHES WASHER HAVING A MOTOR-DRIVEN LID OPENING AND CLOSING MECHANISM

[75] Inventor: Jeong Soo Shin, Suwon, Rep. of Korea

[73] Assignee: Samsung Electronics Co., Ltd., Suwon, Rep. of Korea

[21] Appl. No.: 680,852

[22] Filed: Jul. 16, 1996

[30] Foreign Application Priority Data

Nov. 9, 1995 [KR] Rep. of Korea ..... 1995-40470

[51] Int. Cl.[6] ..... D06F 37/10

[52] U.S. Cl. ..... 68/196; 160/188; 160/213; 220/263; 220/331; 220/333

[58] Field of Search ..... 68/12.26, 23 R, 68/139, 196; 134/57 DL, 58 DL; 292/DIG. 69; 160/188, 206, 213; 312/328; 49/279, 282, 292; 220/263, 264, 331, 333

[56] References Cited

U.S. PATENT DOCUMENTS 2,774,506 12/1956 Miller ..... 160/213 X
3,071,184 1/1963 Peel ..... 160/213
5,546,773 8/1996 Lee ..... 68/196

FOREIGN PATENT DOCUMENTS 259696 11/1986 Japan ..... 68/196

*Primary Examiner*—Philip R. Coe
*Attorney, Agent, or Firm*—Burns, Doane, Swecker & Mathis, L.L.P.

[57] ABSTRACT

A clothes washer includes a lid formed by a first member hinged to a housing of the clothes washer, and a second member hinged to the first member. The first and second members are folded together when the lid is opened, and are unfolded when the lid is closed. A motor-driven lid opening/closing mechanism is provided for opening and closing the lid. That mechanism includes a motor-driven rotary cam member mounted on the housing, and a following member fixed to the first member of the lid. During rotation in one direction, the cam member engages the following member to open the lid, and during rotation in the opposite direction, the cam member engages the following member to close the lid. When the lid is in the closed and open states, the cam member is disengaged from the following member to enable the lid to be manually opened and closed.

7 Claims, 9 Drawing Sheets

CLOTHES WASHER HAVING A MOTOR-DRIVEN LID OPENING AND CLOSING MECHANISM

BACKGROUND OF THE INVENTION

The invention relates to a clothes washer having a lid closing/opening apparatus, and in particular, to providing an automatic lid for closing/opening a clothes-access opening.

A prior art washer, as shown in FIG. 10, is provided with a housing 1, a laundry tub 3 which is rotatably mounted in a water tub (not shown) by a power member (not shown) and rotated. The tub 3 has a plurality of openings 4 in a wall of the laundry tub 3, An upper cover 2 is placed on the upper portion of the housing 1, and a lid is 7 placed on the upper cover 4 for closing/opening an opening 5 of the laundry tub 3. Further, the washing machine is provided with a a pulsator 4 mounted in the water tub 3, and a power member mounted underneath the water tub 3 for transferring the power needed for washing. Further, a washer generally has a control unit (not shown) in which a program for selecting desired washing, rinsing, draining and spinning modes is programmed in advance. The sequence of modes is fully automatically developed.

During the washing mode, the lid can frequently be opened/closed when loading or unloading laundry from/into the laundry tub 3, charging detergent or rinser, and loading additional laundry. Therefore, opening/closing of the lid occurs frequently even during the execution of one washing cycle.

The lid 7, as shown in FIG. 10, is comprised of a first member 8 covering a front portion of a laundry access opening of the housing 1, a second member 9 covering a rear portion thereof, a first hinge 10 for swinging the lid 7 downward or upward around an axis situated at a rear portion of the upper cover 2, and a second hinge 11 provided between the first member 8 and the second member 9 for folding the members 8,9. Furthermore, in the first member 8 there is formed a handle member 12 for enabling the lid 7 to be manually opened or closed.

To load laundry into the laundry tub 3 or unload laundry from the laundry tub 3 a, user grasps the handle member 12 and lifts up the first member 8. The first member 8 approaches the second member 9 about the second hinge 11, thereby folding the lid 7 and exposing the opening 5. On the other hand, to unfold the lid 7 or to close the opening 5, the handle member 12 is pushed down.

As the above description, for handling the lid is inconvenient due to a required manual closing/opening operation thereof.

Further, to satisfy the need of a user preferring a large volume washer, a weighty lid should be employed, thereby making the opening/closing steps more difficult a Accordingly, one object of the invention is to provide a washer, resolving this problem.

Another object of the invention is provide a washer, including an automatic closing/opening lid apparatus for handling the lid conveniently.

SUMMARY OF THE INVENTION

In order to accomplish these objects, a washer comprises a body having a water tub in a vertical shaft; a door for covering an opening of the water tub and providing a foldable second hinge member and a first hinge member hingable to the body; a door close/open apparatus for closing or opening the opening with the door by forward or reverse rotation of a motor.

Further, the door close/open apparatus comprises a cam member placed on the body and for being operated by the motor and a following member fixed on the first hinge member.

BRIEF DESCRIPTION OF THE DRAWINGS

The invention now will be described in detail with reference to the accompanying drawings, in which.

DETAILED DESCRIPTION OF A PREFERRED EMBODIMENT

Figure 1:
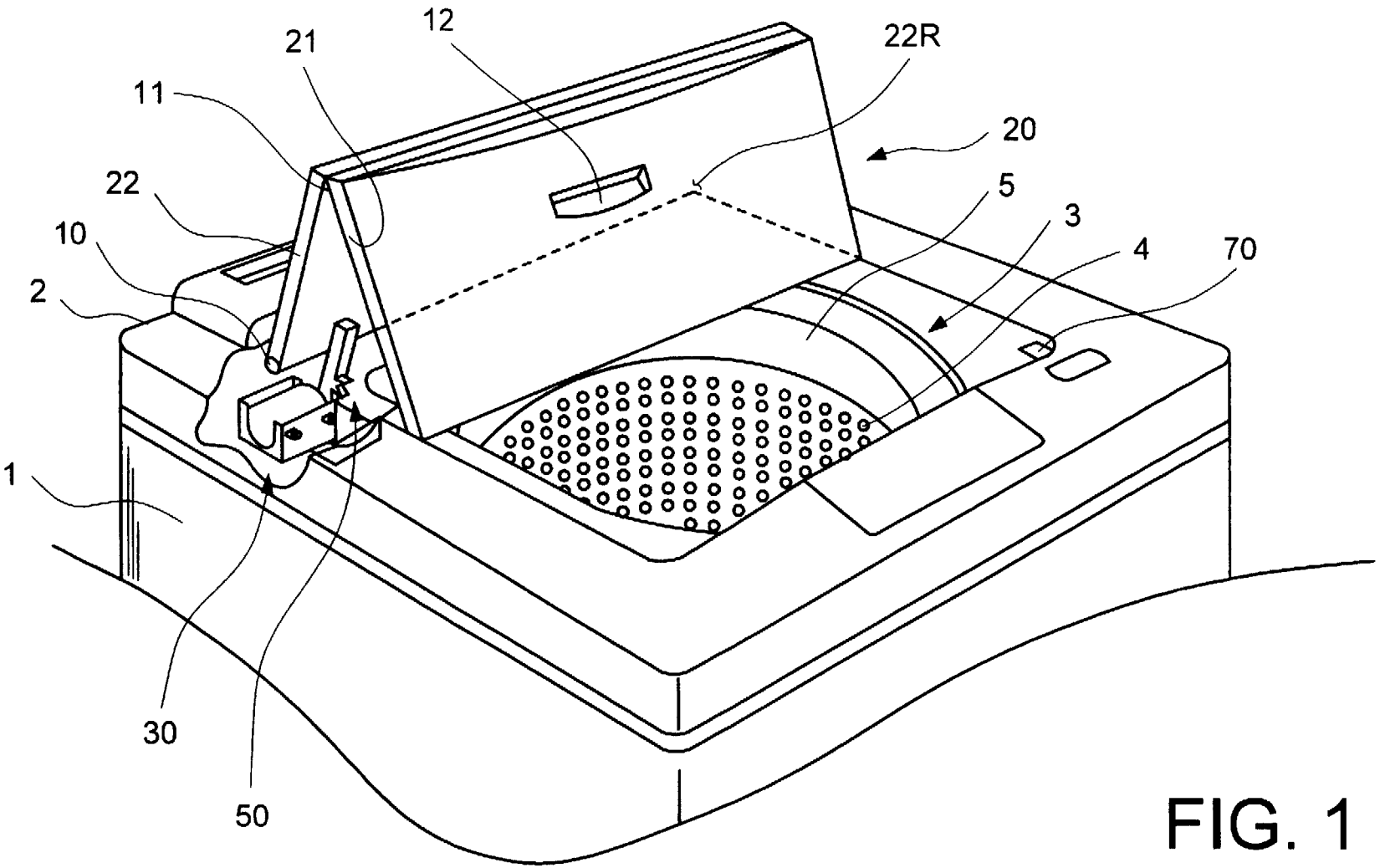
FIG. 1 is a fragmentary perspective view showing a washer having an automatic door close/open apparatus according to the invention.
Figure 10:
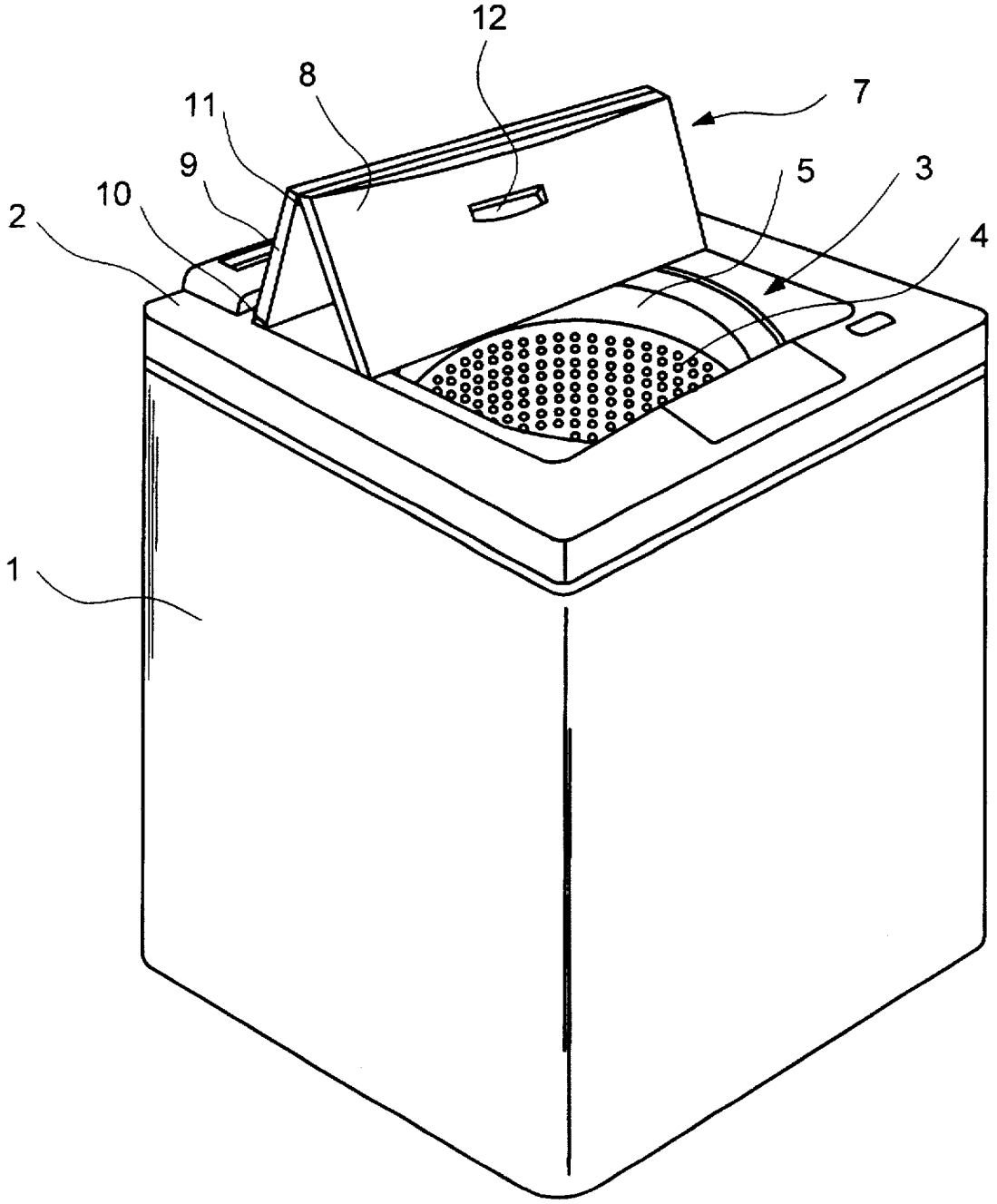
FIG. 10 (PRIOR ART)
FIG. 10 is a fragmentary perspective view showing a washer having a door according to the prior art.

FIG. 1 shows a washer having an automatic door close/open apparatus according to the present invention. The same components as in FIG. 10 are designated by the same numerals. Thus, a detailed description of those parts will be omitted.

The automatic door close/open apparatus comprises a driving rotation device 30 placed in the upper cover 2, and a driven rotation device or following member 50 cooperating with the driving rotation device 30.

The driven rotation device or following member 50 provides a plurality of follow protrusions 51,52,53. The plurality of follow protrusions 51,52,53 receive a rotation torque of the driving rotation device 30 described hereafter to rotate the lid 20 around the first hinge 10 in a clockwise or counterclockwise direction.

The driving rotation device 30 comprises a motor 31 generating a driving force, a driving shaft 32 assembled with the motor 31 and a cam or rotation member 33 fixed to the driving shaft 32. The motor 31, is a geared motor which is able to rotate in bi-directions with a slower speed and higher torque.

The cam member 33 comprises a sector shaped plate 34 and a first driving protrusion 35 and a second driving protrusion 36 which are extended perpendically from the plate 34 are spaced from each other.

For the user's convenience, a foot operated button (not shown) for operating the motor 31 may be installed at the lower portion of the body 1, Also, a one-touch button may be arranged on the control panel (not shown) installed at the upper portion of the washer for being operated by hand.

Further, to stop the operation of the motor 31 at the end of the opening operation and the closing operation of the lid 20, a door open sensor 65 is provided in the rear portion of the upper cover 2, and a door close sensor 70 is provided in the front potion of the upper cover 2. That is, when the lid 20 closes the opening 5 the operation of the motor 31 is stopped by the door close sensor 70, and when the lid 20 opens the opening 5 completely the operation of the motor 31 is stopped by the door open sensor 65. These sensors 65,70 can use a reed switch which is operated such that the motor 31 stops before the lid 20 reaches a fully closed state so that noise generated a quick strike of the lid 20 on the upper cover 2 can be prevented.

At both front sides of the front end of the first member 21 of the lid 20 there are provided respective rolling means 80

Figure 3:
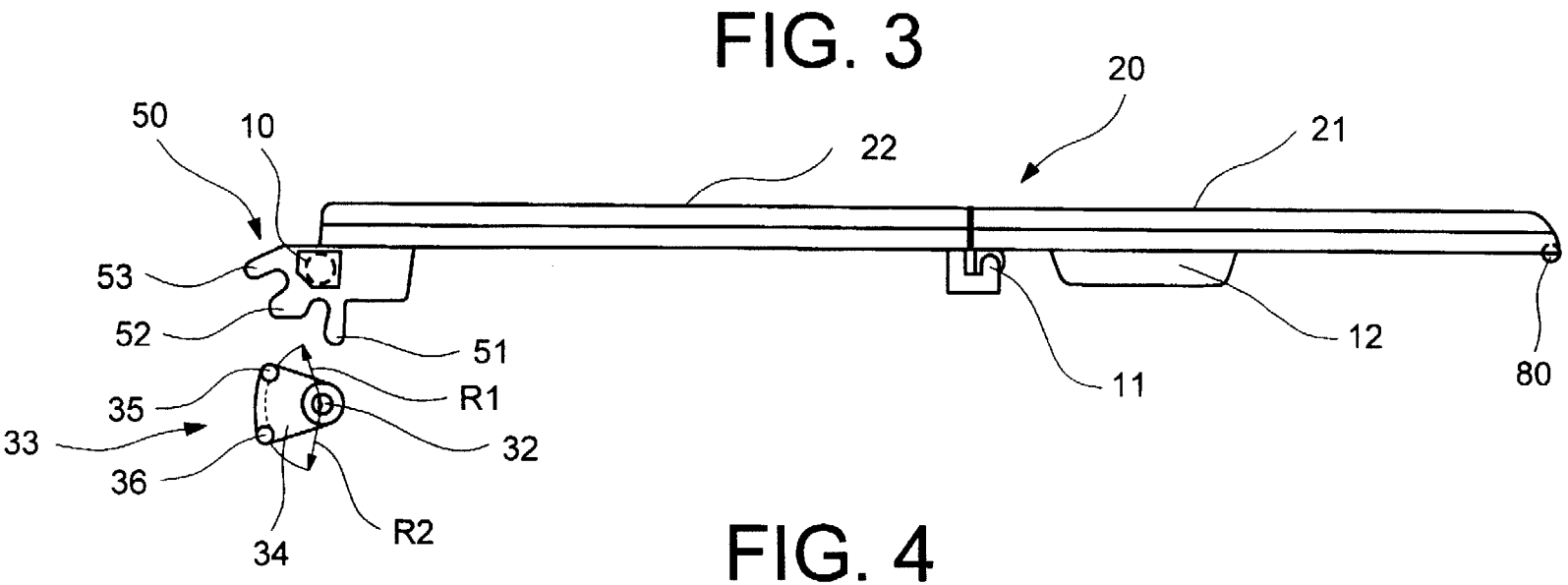
FIGS. 3 to 9 are schematic side elevation views showing the closing/opening sequence.

(FIG. 3). The rolling means 80 rolls on the upper surface of the upper cover 2, enabling the lid 20 to move smoothly. A cylindrical roller or spherical roller can be used for a smoother movement of the lid 20.

Since the cam member 33 and the following member 50 are provided at only one side of the second member 22 of the respective lid 20, the roller 80 tends to floatably move above the upper surface of the upper case cover 2, owing to an unbalanced weight of the lid 20 when being opened. To prevent floating movement of the roller 80, a Q-shape spring can be installed at the other side 22R of the second member 22 of the lid 20 to keep the roller 80 in contact with the upper cover 2.

The lid is operated as follows according to FIGS. 3 to 9. For convenience of description of operation, only essential components, which are represented as the rotating shaft 32 of the cam member 33 and the motor 31, the following member 50 and the lid 20, are illustrated in large scale and concept. FIG. 3 illustrates a position of the cam member 33 and the following member 50 when the lid 20 is closed. In the closed state of the lid 20, the plate 34 arched at about 60° is spaced with some distance from the following member 50, so that the lid 20 can be opened manually. A radius R1 of the first protrusion 35 from the shaft 32 is slightly smaller than a radius R2 of the second driving protrusion 36. Since the first protrusion 35 makes initial contact with the following member 50 during a lid opening operation, the force of the motor 31 is efficiently utilized while the closed lid 20 is lifted from the upper cover 2.

The lid 20 can be lifted by at least one following member coupled with the corresponding driving protrusion. However, if the following member were to employ one following protrusion (51 or 52 or 53), the lid 20 could not be completely lifted, whilst if a plurality of following protrusions are employed, smooth operation of the lid can be achieved. But, the an accurate positional relationship between the driving member and the following member is required. In this embodiment, two driving protrusions and three following protrusions 51–53 are employed.

Figure 4:
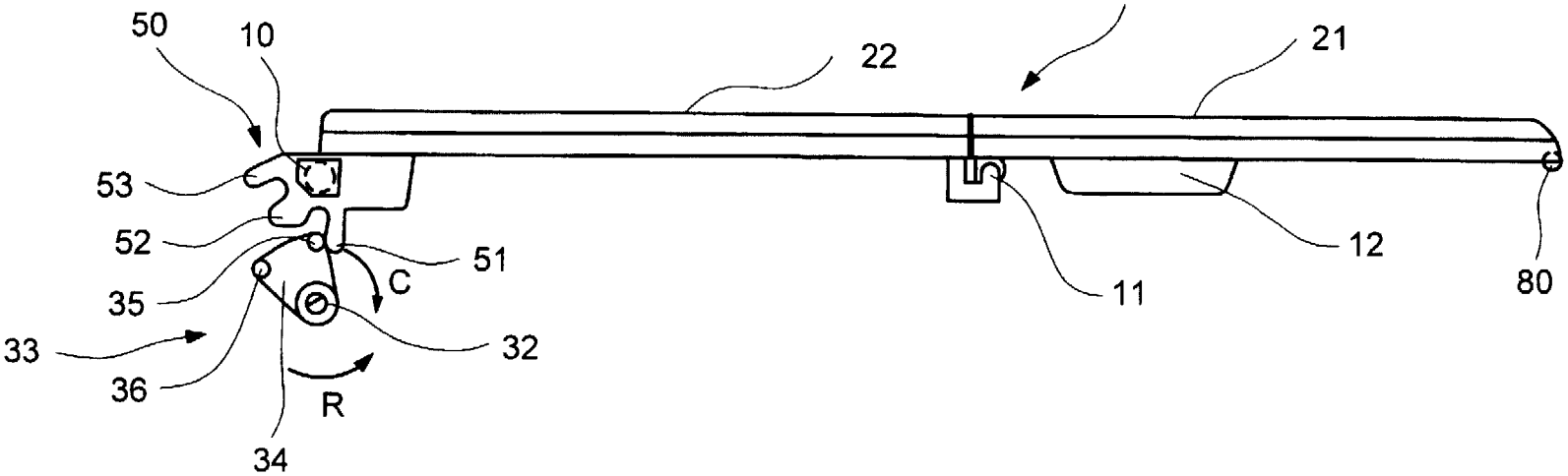

In this condition, the motor 31 is driven by operation of the one-touch button installed at the lower portion of the body 1 and the driving shaft 32 is rotated at low speed. The plate 34 is rotated with the driving shaft 32 in a clockwise direction C. Thus, the first driving protrusion 35 contacts the first following protrusion 51 as shown in FIG. 4. The first driving protrusion 35 pushes the first following protrusion 51 with simultaneous rotation of the plate 34 and the lid 20 is in the beginning stage of opening.

Figure 5:
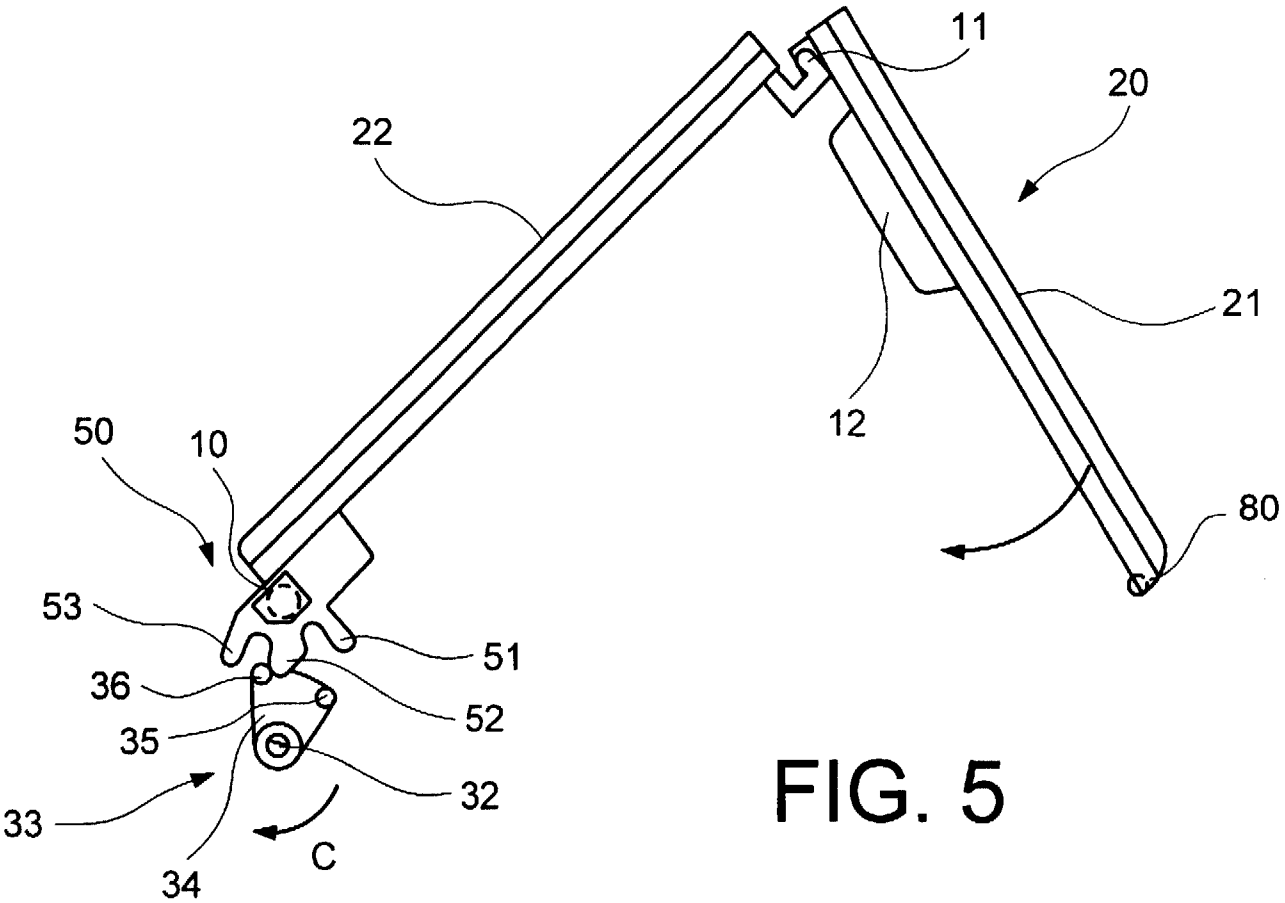

The plate 34 is rotated to a predetermined angle as shown in FIG. 5. The coupling between the first driving member 35 and the first following member 51 is disconnected, and the coupling between the second driving member 36 and the second following member 52 is starting. In this stage, the second member 22 of the lid 20 has swung around the first hinge 10 to about 44°. The roller 80 installed at the front end of the first member 21 slidingly moves along the upper surface of the upper cover 2 in order to enable the first member 21 and the second member 22 to approach each other.

Figure 2:
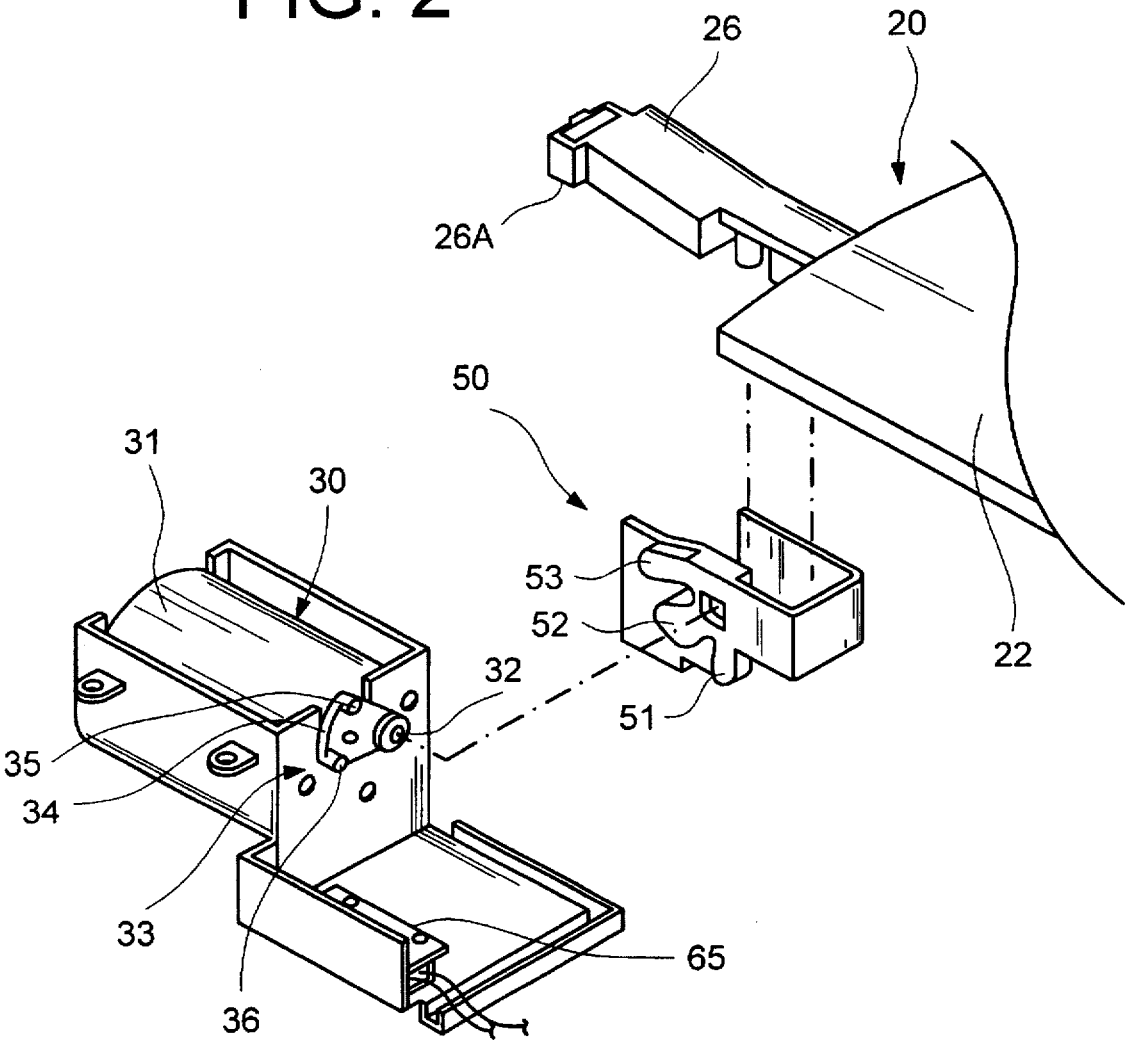
FIG. 2 is a fragmentary exploded perspective view of the automatic door close/open apparatus shown in FIG. 1.
Figure 6:
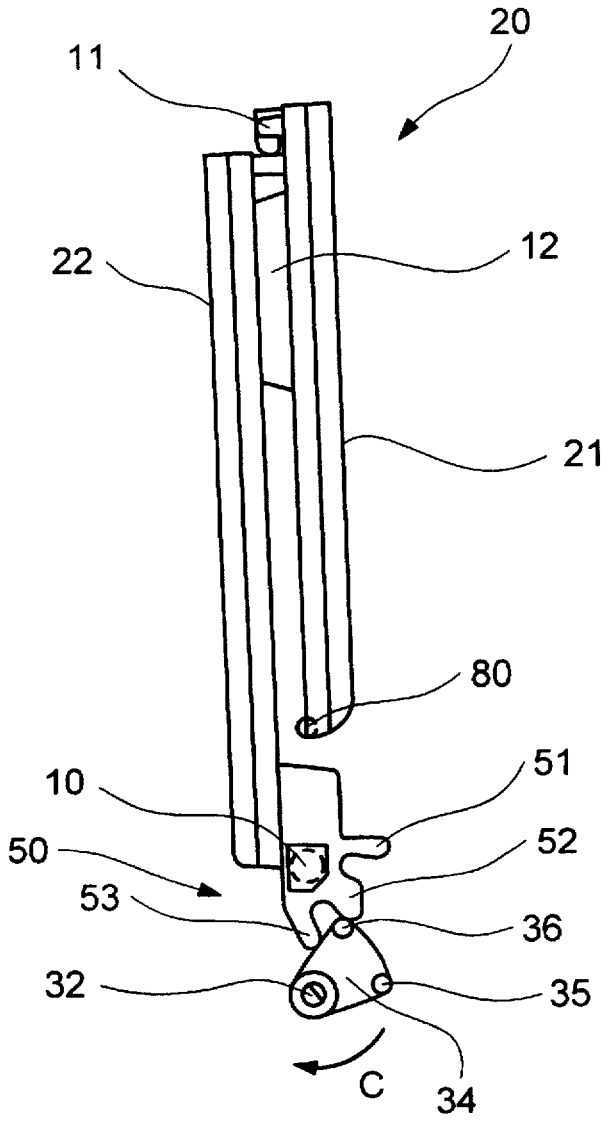

Upon further rotation of the plate 34 by the motor 31, the second driving protrusion 36 is separated from the second following protrusion 52 of the follow member 50. Thus, the lid 20 has been lifted to about 92° as shown in FIG. 6, enabling laundry to be loaded or unloaded. The first member 21 and the second member 22 are folded completely so that the mutually facing inner surfaces of respective members 21,22 contact each other. In this position, a contact 26A formed at the rear end 26 of the lid 20 (FIG. 2) activates the door open sensor 65, stopping the motor 31.

Figure 7:
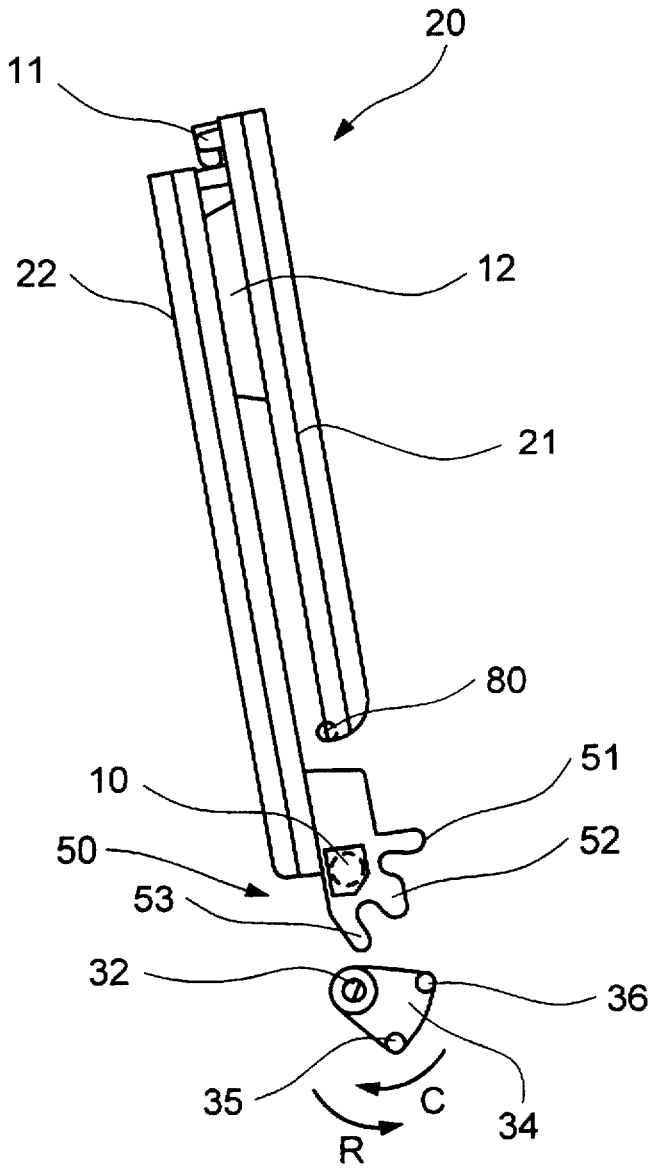

Although the motor 31 is stopped, the plate 34 is further rotated due to inertia of the shaft 32 as shown in FIG. 7. The plate 34 is spaced from the range of rotation of the following member 50, enabling the lid 20 to be closed manually.

Figure 8:
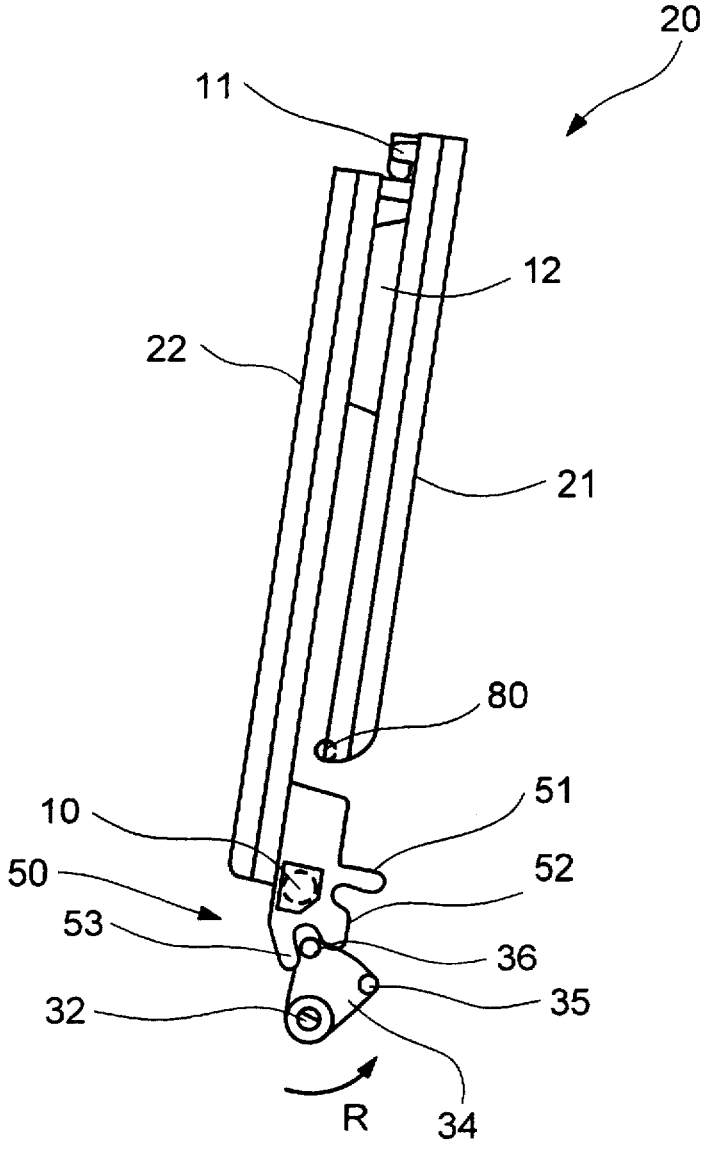
Figure 9:
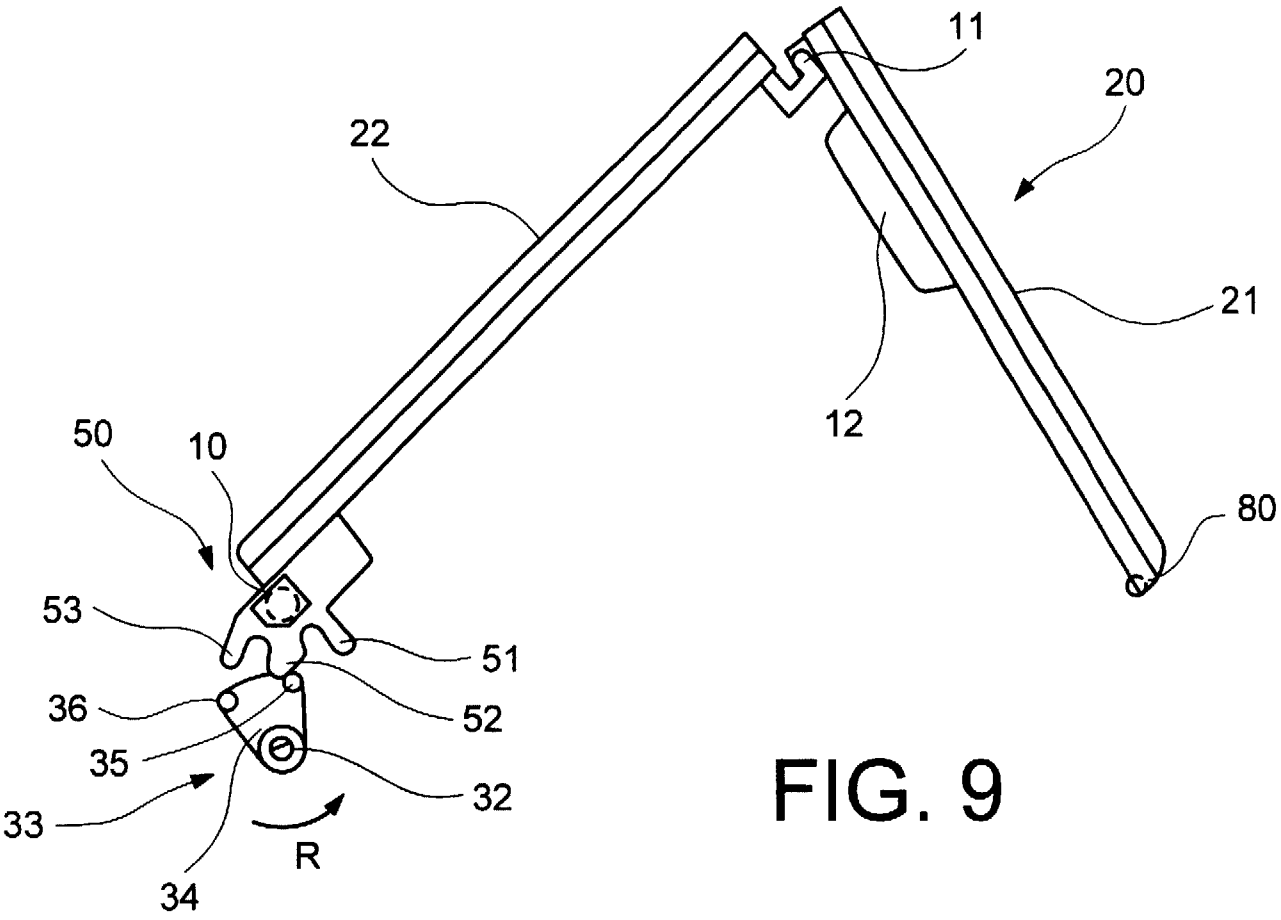

In the situation that the lid 20 is lifted to about 100° (FIG. 7), the one-touch button is repressed and the motor 31 rotates the driving shaft 32 in a counterclockwise direction R. The cam member 33 and the following member 50 are rotated in the reverse direction. Firstly, the plate is rotated in a counterclockwise direction R and the second driving protrusion 36 contacts the third following protrusion 53 as shown in FIG. 8. The further rotation of the plate 34 enables the second driving protrusion 36 to be separated from the third following protrusion 53. The lid 20 has been pushed downward and closes the opening halfway as shown in FIG. 9. Subsequently, the first driving protrusion 35 contacts the second following protrusion 52 and the lid 20 is pushed and closes the opening completely as shown in FIG. 4. At that time, the door close sensor 70 (FIG. 1) is operated so as to stop the motor 31. After that, the plate 34 is further rotated due to inertia of the shaft 32 and is spaced from the rotation range of the following member 50 as shown in FIG. 3. Thus, the lid 20 can be opened manually.

As is apparent from the above explanation, since the lid can be closed or opened automatically the, convenience to user is increased. The present invention can also solve the problem resulting from increasing weight of the lids which are very inconvenient to open/close manually. Further, because the manual mode as well as the automatic mode can both be used, the lid can be opened/closed manually when out-of-power or out-of-order conditions exist.

What is claimed is:

1. A clothes washer comprising:

a housing forming a clothes-access opening at the top thereof;

a water tub mounted in the housing;

a lid disposed at the top of the housing for opening/closing the access opening, the lid including a first member hinged to the housing, and a second member hinged to the first member, the first and second members being foldable to an open state and unfoldable to a closed state; and a motor-driven lid opening/closing mechanism for selectively moving the lid to the open and closed states, wherein the lid opening/closing mechanism comprises a motor mounted on the housing, a cam member fixed to a drive shaft of the motor, and a following member fixed to the lid and arranged to be displaced by the cam member during rotation of the drive shaft.

2. The clothes washer according to claim 1 wherein the lid opening/closing mechanism permits the lid to be manually opened when in a closed state, and to be manually closed when in an open state.

3. The clothes washer according to claim 1 wherein the cam member is engaged with the following member during lid opening and closing operations, and is disengaged from the following member when the lid is in the open and closed states, to permit the lid to be manually opened and closed.

4. The clothes washer according to claim 3 wherein the cam member becomes disengaged from the following member before the lid reaches a fully closed state, allowing the lid to gravitate to the fully closed state.

5. The clothes washer according to claim 1 wherein the cam member includes a plurality of driving protrusions; the following member including a number of following protrusions equal to one more than the number of driving protrusions; the driving protrusions being engaged by respective ones of the following protrusions during rotation of the cam member.

6. The clothes washer according to claim 5 where in one of the driving protrusions is spaced the smallest distance from the drive shaft and is the first driving protrusion to contact the following member during a lid opening operation.

7. The clothes washer according to claim 1 wherein the following member is mounted on the first member of the lid.

* * * * *